US009604704B2

(12) United States Patent
Lisland

(10) Patent No.: US 9,604,704 B2
(45) Date of Patent: Mar. 28, 2017

(54) DUAL AXIS CHAIN STOPPER

(71) Applicant: SCANA OFFSHORE AS, Vestby (NO)

(72) Inventor: Torkjell Lisland, Drøbak (NO)

(73) Assignee: SCANA OFFSHORE AS, Vestby (NO)

( * ) Notice: Subject to any disclaimer, the term of this patent is extended or adjusted under 35 U.S.C. 154(b) by 0 days.

(21) Appl. No.: 15/140,843

(22) Filed: Apr. 28, 2016

(65) Prior Publication Data

US 2016/0318584 A1 Nov. 3, 2016

(30) Foreign Application Priority Data

Apr. 29, 2015 (NO) ..... 20150515

(51) Int. Cl.

*B63B 21/18* (2006.01)
*B63B 21/04* (2006.01)
*B63B 21/20* (2006.01)

(52) U.S. Cl.

CPC ..... *B63B 21/18* (2013.01); *B63B 21/04* (2013.01); *B63B 2021/203* (2013.01)

(58) Field of Classification Search

CPC ..... B63B 21/18; B63B 21/04
USPC ..... 114/199–200
See application file for complete search history.

(56) References Cited

U.S. PATENT DOCUMENTS 7,926,436 B2 * 4/2011 Boatman ..... B63B 21/18 114/200
8,069,805 B2 * 12/2011 De Baan ..... B63B 21/50 114/180
8,770,039 B2 * 7/2014 Dang ..... G01L 5/101 73/828
8,915,205 B2 * 12/2014 Miller ..... B63B 21/10 114/200

OTHER PUBLICATIONS

U.S. Appl. No. 15/147,216, Lisland.

* cited by examiner

*Primary Examiner* — Lars A Olson
*Assistant Examiner* — Jovon Hayes
(74) *Attorney, Agent, or Firm* — Winstead PC

(57) ABSTRACT

A mooring unit for a vessel comprising an arm, a universal joint, and a chain stopper. The universal joint is arranged between the vessel and the arm, and the universal joint is adapted to be pivotally coupled to a bracket and the arm enabling the mooring unit to pivot about a first axis and a second pivot axis, said first and second pivot axes are arranged perpendicular to each other in substantially the same plane. The universal joint includes a link element for receiving a first and second ear pair of the respective arm and bracket. The ears and link element are coupled through journals. The link element includes walls extending on both sides of the respective ears so that the respective journals are supported by both walls.

8 Claims, 9 Drawing Sheets

DUAL AXIS CHAIN STOPPER

FIELD OF THE INVENTION

The present invention relates to mooring of offshore structures, typically floating drilling rigs and drill ships, floating production and storage units. In particular, the invention relates to chain stoppers that reduces fatigue issues generally known as OPB or Out of Plane Bending.

More particularly, the present invention relates to a mooring unit according to the preamble of claim 1.

TECHNICAL BACKGROUND OF THE INVENTION

It is common knowledge that petroleum products extracted from a well is stored on a floating storage facility or on a subsea tank. It is also known that it may be a Floating Production, Storage and Off-loading vessel (commonly known as FPSO) or an Offshore Storage Unit (OSU) which are employed to temporarily store oil received from the well. Subsequently, the oil is transferred to an oil-tanker or similar to bring it to the shore.

The mooring system is a critical component of a floating production platform, and its integrity over the field life is of paramount importance. Where the platform has a drilling or workover rig, an active mooring system enables the platform to position itself over the well.

Spread mooring consists of multiple legs that are connected to the platform by fairleads and tensioners and to the seabed by anchors. In deep water, each leg is typically made up of either steel wire or synthetic rope over most of its length, with a small segment of chain at the top and bottom. The mooring spread could be symmetrically arranged or grouped around the platform. The mooring legs must resist forces and motions induced by the platform in response to extreme weather conditions. Design codes specify safety factors for line break strength and fatigue life that are not to be exceeded by loads induced in the mooring legs.

Mooring systems resist steady environmental loads by generating a restoring force created by unbalanced horizontal tensions of the mooring array when the vessel offsets from its mean position.

It is of utmost importance that there must be appropriate mooring units, including chain stopper, to ensure optimal positioning of the vessel.

OPB fatigue occurs where two chain links are in contact and when one of the links rotates relative to the other, introducing bending moments. The reason for these rotations is that the moored vessel is constantly moving due to waves, wind and currents in relation to the anchor, which is fixed on the seabed. When this happens, the chain angle between the anchor and the vessel changes.

These changing chain angles introduce bending moments in the chain, which may over time break the chain due to fatigue. The present invention aims to reduce these interlink rotations by introducing a universal joint designed to take the constantly changing movement. In principle, one end of the universal joint is attached to the vessel and the other part to the mooring chain.

Additionally it shall be possible to pull the chain through the unit for installation, pre-tensioning, chain replacement and decommissioning.

There are a number of patents relating to the out of plane bending (OPB) challenges.

Publication U.S. Pat. No. 7,926,436 shows a dual chain axis stopper, which has a universal joint that is pivotally coupled to a vessel in one end and a mooring unit arm in a second perpendicular end. The coupling are situated in two different planes defines by axes extending through two oppositely arranged shaft on the universal joint. The axes are situated in two different planes defined by shafts in the universal joint that are coupled to the vessel or mooring unit arm. The shaft in the upper part of the universal joint are coupled to the vessel and the shafts in the lower part of the universal joint are coupled to the mooring unit arm. Along the mooring unit arm, at a distance from the lower axis, there is arranged a chain stopper. This distance between the chain stopper and the bearings of the axes makes the rotation of the universal joint as easy as possible and will overcome the friction the bearing. The disadvantage with the arrangement of the publication is that the mooring unit and hence the chain will primarily move about the shafts in the two perpendicular directions. When the universal joint is rotated in one direction this could cause the chain to contact the mooring unit that could cause fatigue problems in the chain and especially out of bend fatigue problems. The rotation mooring in two planes is also disadvantageous because the bending moments of the brackets are higher when the direction of the rotation is restricted. The chain support according to the invention is advantageous over prior art in that the invention reduces the out of plane fatigue problems as the dual chain stopper according to the invention allows movement in the same plane. This provides further a mooring arrangement that is adapted to bend in approximately any directions since the axes are arranged in substantially the same plane. This will thus reduce fatigue problems that can occur due to movement of the vessel in relation to the mooring arrangement attached to the seabed. It is also possible to pull the chain through the chain support for installation, pre-tensioning, chain adjustments, chain replacement and decommissioning.

The drawbacks in the prior art publications have triggered the need for a mooring unit that will reduce the bending forces acting on the connection point on the vessel, for example the bracket.

OBJECTS OF THE INVENTION

It is the prime object of the present invention to provide a mooring unit that will more easily pivot to align with the direction of the mooring force acting on a chain secured to the mooring unit.

It is another object of the invention to provide a mooring unit that is capable of pivoting about two axes perpendicular to one another and in approximately the same plane. This results in that the mooring arrangement are allowed to move in approximately any direction to avoid out of plane bending and fatigue of the chain or the bracket.

It is another object of the invention to have an arrangement where the journals are supported on to sides. This provides an arrangement with improved bearing life compared to arrangements with trunnion mounted journals.

It is another object of the invention to provide a mooring unit where it is possible to pull the chain through the mooring unit for installation, pre-tensioning, chain adjustment, chain replacement and decommissioning.

It is yet another object of the present invention to provide a mooring unit where the bending moments from the chain into the hull of the vessel are reduced.

It is another object of the present invention to provide supported bearings for an increased lifetime of the bearings.

It is another object of the present invention to provide load cells for monitoring of the tension in the direction of the chain axis.

All through the specification including the claims, the words "vessel", "ship", "oil-tanker", "anchoring", "mooring unit", "turret", "chain", "swiveling", "chain stopper unit" "actuator lever" are to be interpreted in the broadest sense of the respective terms and includes all similar items/devices/methods in the field known by other terms, as may be clear to persons skilled in the art.

Restriction/limitation, if any, referred to in the specification, is solely by way of example and understanding the present invention. Further, the term "mooring unit" should be understood to mean a unit that couples a chain of a mooring to an object to be moored. The term "chain stopper" should be understood to mean a unit or features that retain the chain in relation to the mooring unit.

SUMMARY OF THE INVENTION

The invention relates to a mooring unit for mooring of a vessel, comprising a mooring unit arm and an universal joint with a passage for a mooring chain a chain stopper arrangement adapted to retain the chain relative to the mooring unit, said universal joint is arranged between the vessel and the mooring unit arm, said universal joint is adapted to be pivotally coupled to a vessel mounted bracket and the mooring unit arm enabling the mooring unit to pivot about a first pivot axis and a second pivot axis, said first and second pivot axes are arranged perpendicular to each other in substantially the same plane, said universal joint comprising a link element adapted to receive a first pair of ears of the mooring arm and a second pair of ears of the bracket and a first pair of journals coupling said first pair of ears to said link element and a second pair of journals coupling said second pair of ears to said coupling element. The invention is distinctive in that each ear is received in a slit in said link element so that a wall of the link element is formed on both sides of said ear, said respective one of said journal extending through both said walls and said ear so that the respective journals is supported by both walls.

This provides a mooring unit where the out of plane bending fatigue problems are reduced. The invention also provides a mooring unit that is compact because the length of the universal joint is reduced compared to existing solutions.

It also provides a connection between the vessel and the mooring unit where the journals are supported on both ends, such that wear and fatigue are reduced.

In a convenient embodiment, the mooring unit pivots about the horizontal pivot axis by a journal on either side of the mooring unit arm. Thereby, a space is created between the journals through which a chain can extend.

In a preferred embodiment, the mooring unit comprises a hinge that is arranged substantially perpendicular on the substantially horizontal pivot axis. Thereby the mooring unit can pivot in all directions within a conical space. This avoids an out of plane bending of the mooring unit if the direction of the mooring force shifts sideways.

Further preferred, the chain lock comprises a chain stopper arrangement having chain stopper levers to support a chain link, said chain link stoppers in a first position retaining the chain and in a second position releasing the chain. This provides a simple but yet secure means for retaining the chain to the mooring unit.

Further preferable, the mooring unit comprises at least one chain stopper for guiding the chain, the chain stopper being located at a bottom portion of the mooring unit arm of the mooring unit. The chain stopper will also assist in orienting the mooring unit in line with the direction of the mooring force. The chain stopper will also increase the contact area between the mooring unit and the chain, and hence reduce wear.

Preferable embodiments of the mooring unit are defined in the dependent claims, to which reference are made.

BRIEF DESCRIPTION OF THE DRAWINGS

Having described the main features of the invention above, a more detailed and non-limiting description of some exemplary embodiments, with reference to the drawings are provided below.

DETAILED DESCRIPTION OF THE INVENTION

Figure 1A:
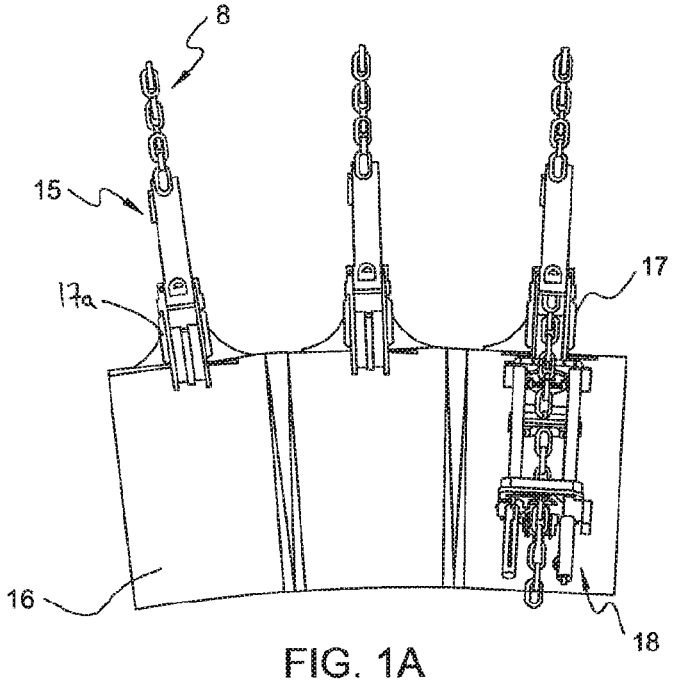
FIG. 1*a*-1*d* shows an overview of the linear anchor winch arrangement with a mooring unit according to the invention shown from different sides.

The following describes three preferred embodiments of the present invention which are purely exemplary for the sake of understanding the invention and non-limiting.

In all the figures, like reference numerals represent like features. Further, when in the following it is referred to "top", "bottom", "lower", "upper" "upward", "downward", "above" or "below", "right hand side" or "left hand side" and similar terms, this is strictly referring to an orientation with reference to the sea bed, where the sea bed is considered to be horizontal and at the bottom. Left and right refer to the orientation in the drawings.

It should also be understood that the orientation of the various components may be otherwise than shown in the drawings, without deviating from the principle of the invention. Furthermore, the disposition of off-shore units like off-shore storing facilities, vessels/ships/oil tankers and related units are not shown in detail, as those are not consequential to the present invention and should be understood by persons skilled in the art.

FIG. 1*a*-1*d* shows a mooring unit 15 according to an embodiment of the invention attached to a vessel 16.

Figure 1B:
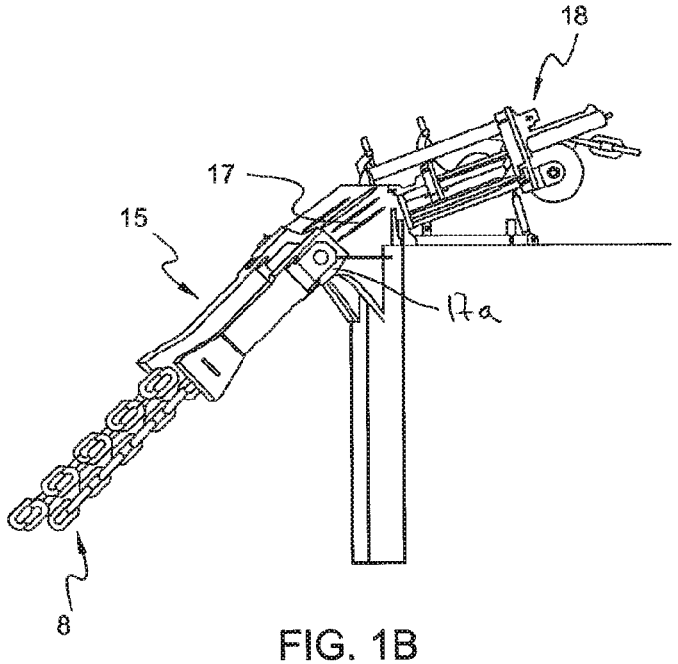
Figure 1C:
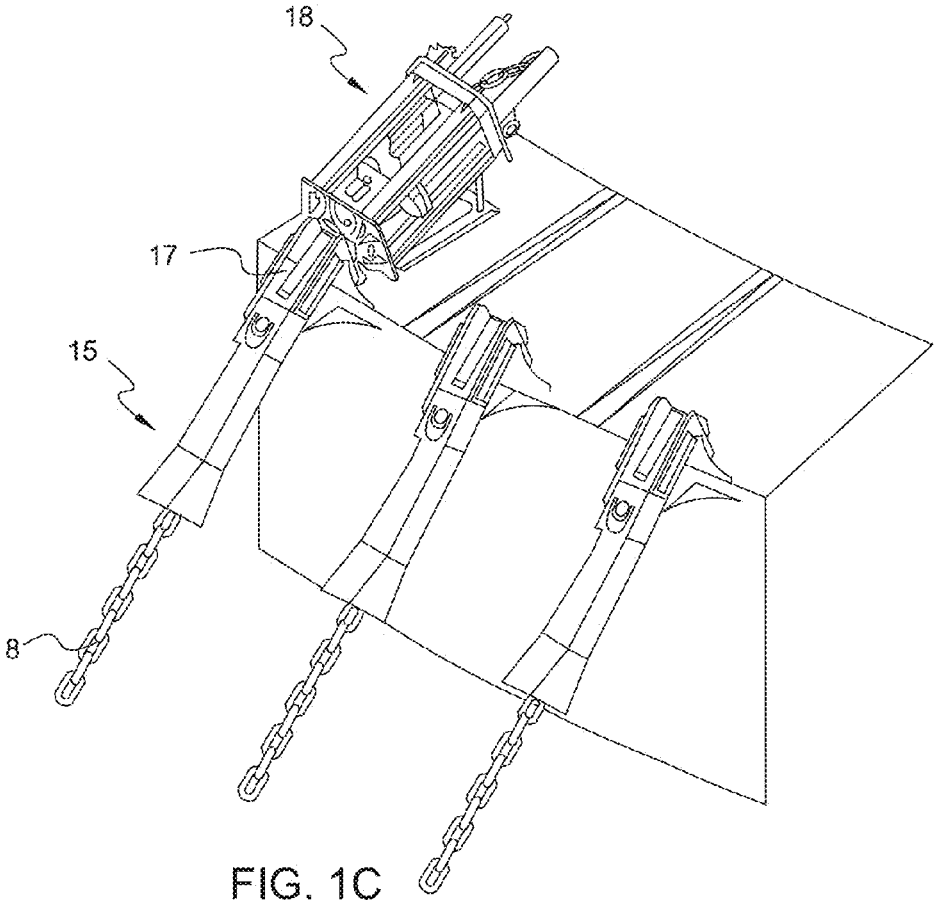
Figure 1D:
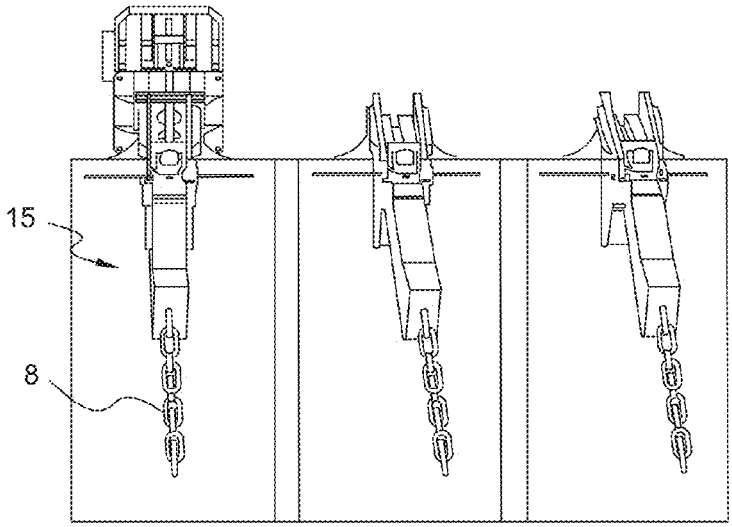

FIG. 1*a* shows the mooring unit 15 viewed from above. The FIG. 1*b* and FIG. 1*c* shows the mooring unit viewed from the side. FIG. 1*d* shows a front view of the mooring unit 15. The mooring unit 15 is in one end attached to the vessel 16 through a bracket 17. The bracket 17 is integrated with the vessel.

A chain 8 is fed through the mooring unit 15 by a winch 18 arranged on the vessel 16 and secured to the seabed (not shown).

The FIGS. 1*a*-1*d* are illustrating several mooring units arranged beside each other in connection with each of the chains 8 extending from the vessel towards the seabed. The number of mooring units 15 depending on the number of chains 8 extending from the vessel towards the seabed.

In the FIG. 1*a*-1*d*, there are shown three mooring units, arranged beside each other and attached to the vessel. The mooring unit could also be applied to mooring turrets, this being an embodiment of the invention.

Figure 2:
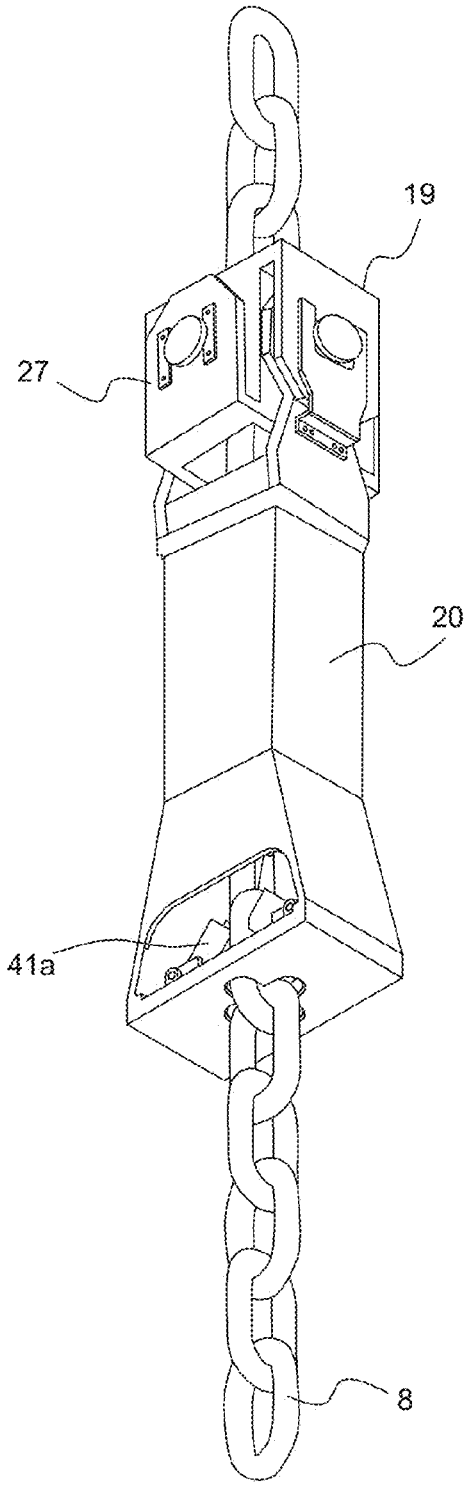
FIG. 2 shows a perspective view of the mooring unit according to the invention.

FIG. 2 shows a perspective view of the mooring unit according to the invention In the figure, the mooring unit 15 has a shape of a elongate member hereinafter called a mooring unit arm 20 and has a box-shaped part hereinafter called an universal joint 19 arranged at the first or upper end 15*a*. The first end is connected to the vessel 16 through brackets 17. This will be described in further detail in FIG. 4-FIG. 6.

At or near a second end or lower end of the mooring arrangement, there is arranged at least one chain stopper 41*a*. This will be further described in FIG. 11-13.

Figure 3:
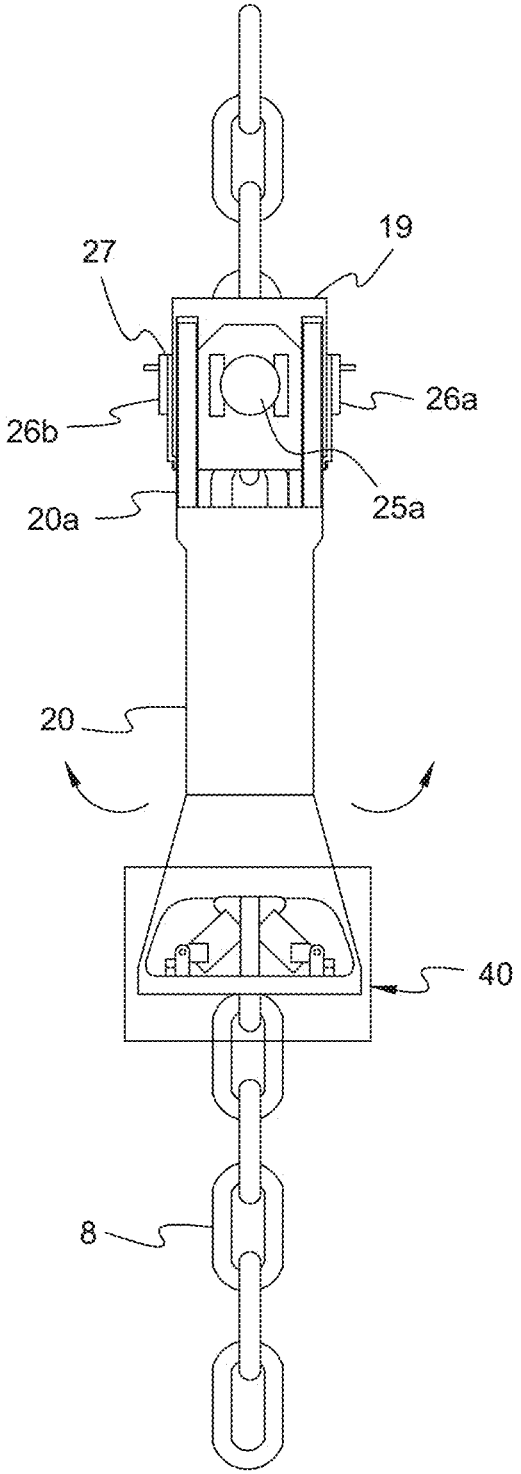
FIG. 3 shows the mooring unit, viewed from the side.

FIG. 3 is shows the mooring unit 15 viewed from the side. This is equal to the side shown in FIG. 1*b* when the mooring unit 15 is attached to the vessel 16. The mooring unit 15 has a hinge connection with the bracket 17 on the vessel 16 and can pivot about a first pair of journals 25*a*, 25*b*. The arrows in FIG. 3 shows the pivoting direction.

Figure 4:
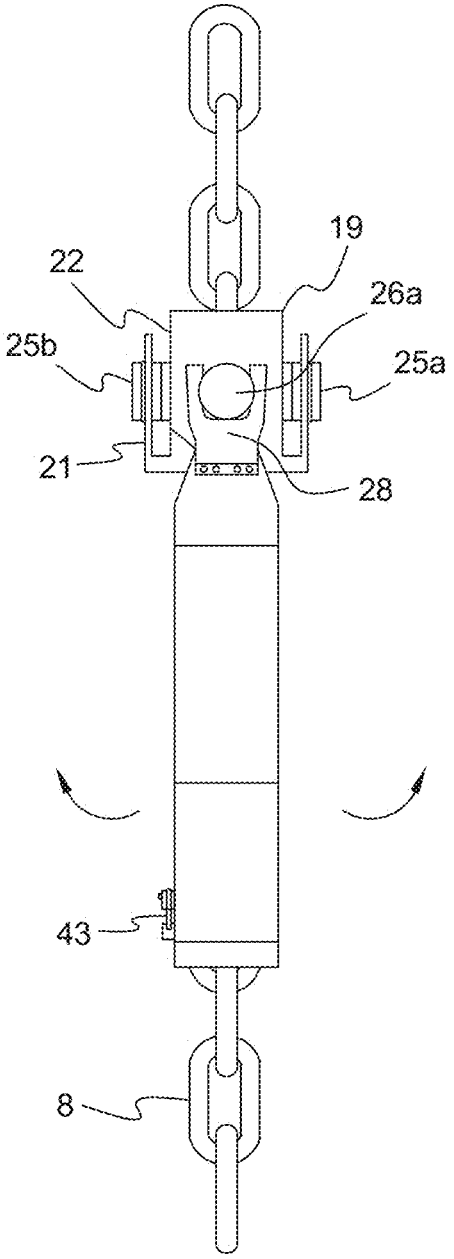
FIG. 4 shows the mooring unit, viewed from the front, i.e. a side perpendicular to the side viewed in FIG. 3.

FIG. 4 shows the mooring unit 15, front side viewed. This equals the side shown in FIGS. 1*a* and 1*d* when the mooring unit 15 is attached to the vessel 16. The mooring unit 15 has a hinged connection between a universal joint 19 and a lower mooring unit arm 20. The mooring unit arm 20 of the mooring unit 15 can pivot around a first pair of journals 26*a*, 26*b* shown in FIG. 9 in the direction of the arrows shown in the FIG. 4.

The universal joint 19 of the mooring unit 15 is shown in more detail in FIGS. 5-7 and 8-10. These Figures show two perpendicular sides of the universal joint 19 respectively front viewed and side viewed as defined in FIGS. 3 and 4. The universal joint has a cubical shape where the four sides extending downwardly from a top plate 19*a*. The four sides are defined as two reciprocal side plates 19*b* and reciprocal front plate and rear plate 19*c*.

Figure 5:
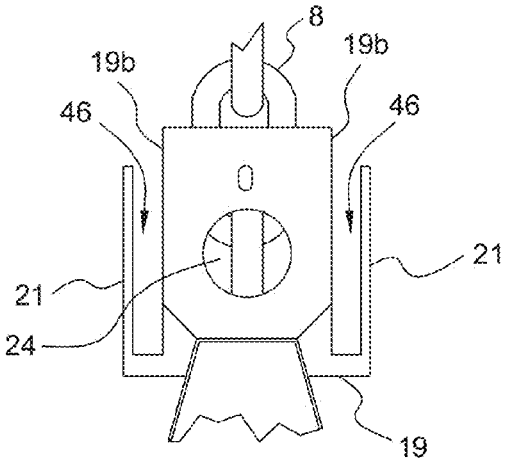
FIG. 5 shows a detailed view of the first end of the mooring unit, shown without any connection parts, viewed from the side.
Figure 15:
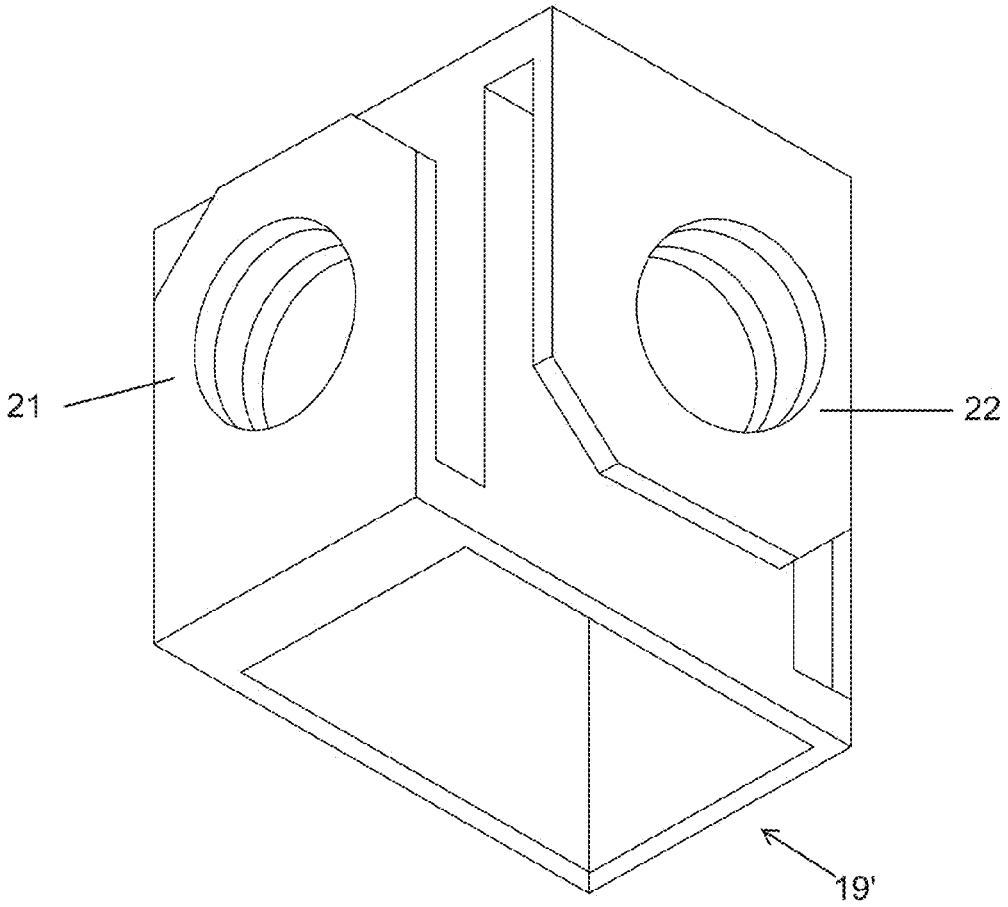
FIG. 15 shows the link element.

The universal joint as shown in FIG. 5 and FIG. 15 without the first pair of journals 25*a*, 25*b* and the second pair of journals 26*a*, 26*b* is hereinafter called a link element 19'.

Figure 6:
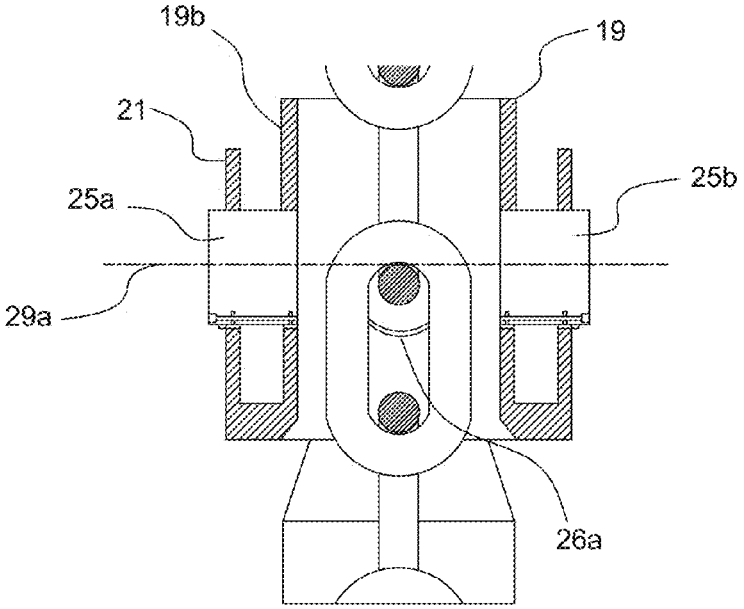
FIG. 6 shows a cross-section of the first end of the chain stopper along the line A-A in FIG. 3, viewed from the same side as FIGS. 4 and 5.

As shown in FIG. 5 and FIG. 6 there are additionally upwardly extending walls 21 arranged outside of each of the side plates 19*b*, so that slits 46 are formed between the side plates 19*b* and walls 21 at both sides of the universal joint 19. These slits are adapted to receive downwardly extending ears 17*a* on the bracket 17 attached to the vessel. (Bracket ears are shown in FIGS. 1*a* and 1*b*). There are arranged openings 23 (shown in FIG. 8) in each of the side plates and corresponding openings in the upper extending walls 21 and bracket ears 17*a*. These openings are adapted to receive the first pair of journals 25*a*, 25*b*. There are arranged first journals 25*a*, 25*b* at each of the opposite sides 19*b*. Each first journal 25*a*, 25*b* is extending from the side plate 19*b* through the bracket ear 17*a* and the upwardly extending wall 21. Each of the first journals 25*a*, 25*b* are secured at the outside by a bolt locking plate 27 (shown in FIG. 3) or by two bolt locking plates 27, but the first journals 25*a*, 25*b* could also be secured in other ways in the openings.

The respective first journals 25*a*, 25*b* is supported on two sides to improve the bearing life. As shown in FIG. 6 each of the first journals 25*a*, 25*b* is supported by the side plate or wall 19*b* and the parallel wall 21. The two side support of the journals 25*a*, 25*b* may also be on the universal joint 19, bracket 17 of the vessel of the mooring unit arm 20 or a combination of these.

Figure 7:
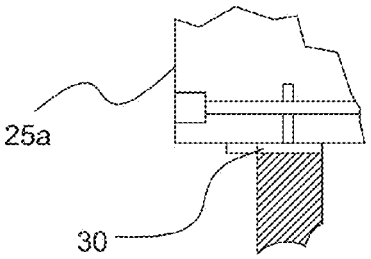
FIG. 7 shows a detailed view of the section H of FIG. 6.

Between the opening in the respective side plates 19*b*, walls 21 and bracket ears 17*a* and the first journal 25*a*, 25*b* there is arranged bushings 30 to provide a bearing surface for each of the first journals 25*a*, 25*b*. This could for instance be a bronze bushing, but other bushings 30 are also possible. A part of the bushing 30 around one of the first journals 25*a*, 25*b* is shown in FIG. 7.

Figure 8:
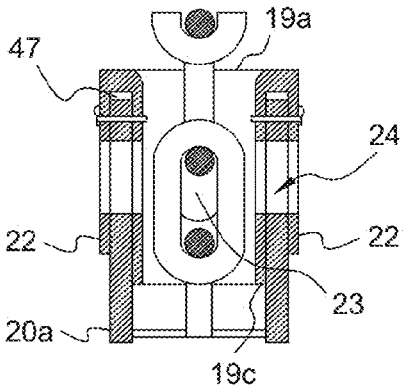
FIG. 8 shows a cross sectional view of the first end along the line D-D in FIG. 5.
Figure 9:
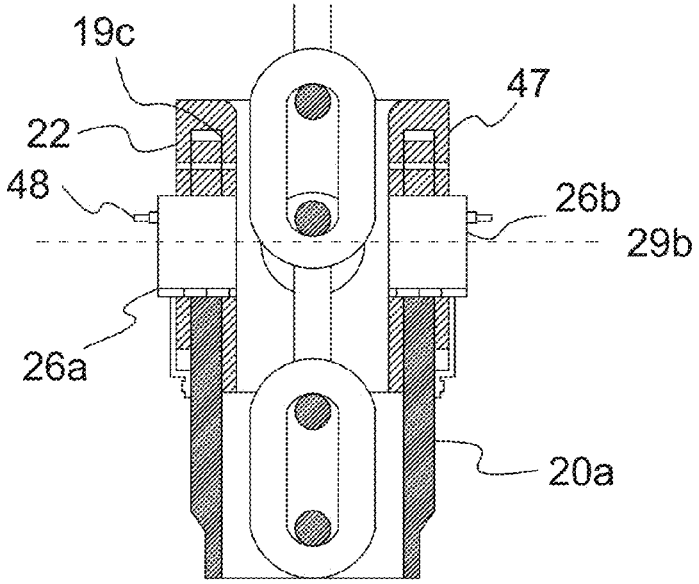
FIG. 9 shows a detailed view of the first end along the line B-B in FIG. 4, viewed from the front as in FIG. 3 and FIG. 8.

In FIGS. 8 and 9, there are shown additionally downwardly extending walls 22 arranged outside of each of the front and rear plates 19*c* so that slits 47 are formed between the downwardly extending walls and the front or rear plates 19*c* in the front and rear side of the universal joint 19. These walls 22 are each adapted to receive an upwardly extending ear 20*a* integrated with the mooring unit arm 20. The ears 20*a* are arranged at the first end of the mooring unit arm 20 as an extension to this. There are arranged openings 24 (shown in FIG. 5) in the front and rear plates 19*c* and corresponding openings in the upwardly extending walls 22 and the ears 20*a* of the mooring unit arm 20. These openings 24 are adapted to receive a pair of second journals 26*a*, 26*b* (shown in FIG. 9). Each second journal 26*a*, 26*b* is extending from the front or rear plate 19*c* through the ear 20*a* of the mooring unit arm 20 and the downwardly extending wall 22. Each second journal 26*a*, 26*b* could be secured at the outside of each of the downwardly extending walls 22 by a carrier plate 28 as shown in FIG. 4. The second journals 26*a*, 26*b* could also be secured in the openings by other means.

The respective second journal 26*a*, 26*b* is supported on two sides to improve the bearing life. As shown in FIG. 9, each of the second journals 26*a*, 26*b* is supported by the front/rear plate or wall 19*c* and the parallel wall 22. This is similar to what is as described above with respect to the first journals 25*a*, 25*b*. The two side support of the second journals 26*a*, 26*b* may also be on the link element 19, bracket 17 of the vessel of the mooring unit arm 20 or a combination of these.

Figure 10:
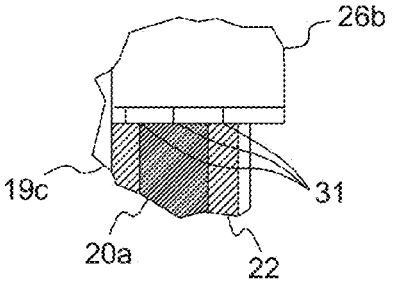
FIG. 10 shows a detailed view of section J from FIG. 9.

Similar bushings 31 are arranged in the openings in the front and rear plate 19*c*, the respective downwardly extending walls 22 and the ears 20*a* of the mooring unit arm 20. A detail view of a bushing 31 around the second journal 26*a*, 26*b* is shown in FIG. 10. The bushing 31 could be equal to the bushing as described in FIG. 7.

In another embodiment of the invention, there are arranged load pins for tension monitoring instead of the second journals 26*a*, 26*b*. The load pins are fixed to the mooring unit arm 20 for rotation in order to measure tension in the direction of the chain axis. The use of load pins are well known to the person of skill per se.

The top plate 19*a*, side plates 19*b*, front plate/rear plate 19*c*, the upwardly extending walls 21 and downwardly extending walls 22 are preferably made in one integral piece.

The pivotal connection between the bracket 17 and universal joint 19 of the mooring unit 15 results in the mooring unit 15 being rotatable around the axis of the first journals 25*a*, 25*b* in the direction of the arrows shown in FIG. 3.

Similarly, the pivotally connection between the mooring unit arm 20 and the universal joint 19 of the mooring unit 15 result in a rotation of the mooring unit arm 20 around the axis of the second journals 26*a*, 26*b* in the direction of the arrows shown in FIG. 4.

The pair of first journals 25*a*, 25*b* and the pair of second journals 26*a*, 26*b* are arranged in openings that are arranged in substantially the same plane. This plane is defined by a line 29*a* through the axes of both the first journals 25*a*, 25*b* and a line 29*b* through the axis of both the second journals 26*a*, 26*b*. These lines are arranged perpendicular to each other. The plane through these lines is substantially parallel with the top plate 19*a* of the universal joint 19.

FIG. 3 also shows a chain stopper arrangement at or near a second end of the mooring unit 15. This arrangement is shown in detail in FIG. 11-13.

Figure 11:
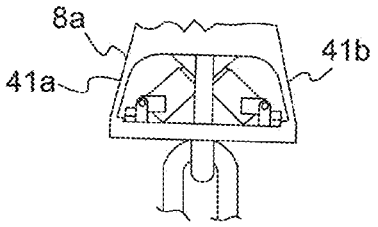
FIG. 11 shows the chain latches arranged at or near the second end of the mooring unit, viewed in a closed position.
Figure 12:
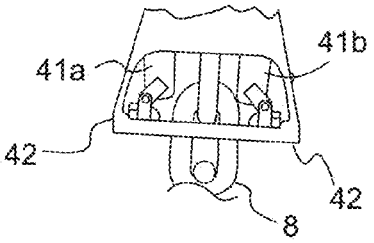
FIG. 12 shows the chain latches arranged at or near the second end of the mooring unit, viewed in an open position.

FIGS. 3, 11 and 12 show a pair of chain stoppers 41*a*, 41*b* hereinafter called latch pins 41*a*, 41*b*. These are arranged on both sides of the chain 8 when the chain 8 is extending through the mooring unit 15. Each latch pin 41*a*, 41*b* is pivotally connected to the mooring unit 15 in a first end and having a free second free end.

In an embodiment of the invention, the chains stopper arrangement could be of the flapper type. The main purpose of the chain stopper arrangement is that it can take the loads of the mooring unit and open for the chain to come through during chain handling. Thereby the tension winch 18 braking system does not need to take up the load.

The FIG. 11 shows the pair of latch pins 41*a*, 41*b* in a closed position. In this position the latch pins 41*a*, 41*b* are tilted towards each other and towards the chain 8 to support a chain link 8*a* from below. This support from both sides of the chain link 8*a* of the chain 8 prevents the chain 8 from moving in relation to the mooring unit 15 towards the sea.

FIG. 12 shows the pair of latch pins 41*a*, 41*b* in an open position. The latch pins 41*a*, 41*b* are rotated away from the chain 8 to a position that is substantially parallel with the longitudinal direction of the chain 8, as shown in FIG. 12. In this position, the chain is free to move in relation to the mooring unit 15.

Figure 13:
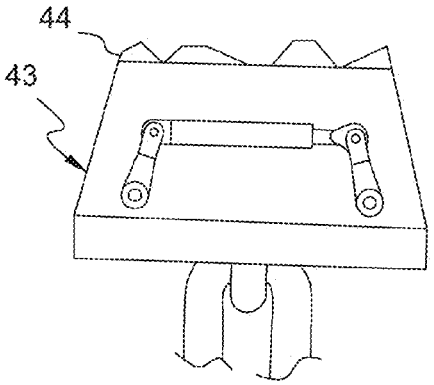
FIG. 13 shows the chain latches mechanism arranged at or near the second end of the mooring unit.

FIG. 13 shows a chain stopper operation mechanism 43. This is shown as an actuator coupled to a lever 44 and is adapted to rotate the pair of latch pins 41*a*, 41*b* towards each other or away from each other, depending whether the chain 8 should be supported or not. The different positions are shown in FIGS. 11 and 12.

Figure 14:
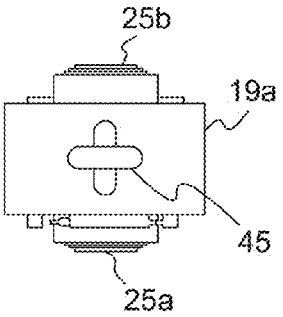
FIG. 14 shows the mooring unit, topside view.

FIG. 14 shows the mooring unit 15, topside viewed. The top plate 19*a* of the universal joint 19 is shown with a cross shaped opening 45, the opening 45 is fitted to the shape of the chain 8 so that the chain links 8*a* are allowed to be lowered through the top plate 19*a* and down through the mooring unit 15 and also moved within the mooring unit.

The total weight of the mooring unit 15 could for example be approximately 6000 kg.

The mooring unit arm 20 could also have a hollow structure that may be open or at least partly open.

Now the functioning of the mooring unit 15 is explained and for that purpose, the figures are again referred to without going much into the structural details again, for the sake of avoiding repetition.

When the vessel and mooring unit already installed, has been positioned above the site where it is intended to be moored, the chain 8 is lowered from the ship and passed through mooring unit 15. The chain 8 is then passed through the bottom portion of the mooring unit arm 20 and passed through the chain stopper arrangement 40 and between the latch pins 41*a*, 41*b* at the bottom portion of the mooring unit arm 20 of the mooring unit 15.

The chain 8 is led through the mooring unit mooring unit arm 20 while the latch pins 41*a*, 41*b* are arranged in the upright, open position as shown in FIG. 12. When the chain 8 has been fed through the mooring unit 15 and connected to the mooring in one of several possible known ways that are available to the person of skill, the chain 8 is tightened. The latch pins 41*a*, 41*b* are now closed by moving the free end of the latch pins 41*a*, 41*b* towards the chain 8 so that the latch pins 41*a*, 41*b*, catch a chain link 8*a* in a way known per se.

The universal joint 19 ensures that the chain stopper arrangement 40 via the mooring unit arm 20 can rotate freely with respect to the vessel 16. It has two perpendicular axes located in the same plane to reduce the bending moment from the mooring system into the vessel (through the bracket attached to the vessel) The journals 25*a*, 25*b*, 26*a*, 26*b* connecting the link element 19' in both directions are supported on two sides to improve bearing life. They are not trunnion mounted, which would have created a substantially higher local stress on the journals.

Furthermore, the universal joint/link element has a hollow core to let the chain through the mooring unit 15. The second pair of journals 26*a*, 26*b* connecting the universal joint to the mooring unit arm 20 can be replaced by load pins for tension measurement (not shown) They will be fixed to the mooring unit arm 20 in order to measure the tension axially in the direction of the main axis of the mooring unit arm 20 and the chain 8.

The mooring unit arm 20 is the connection between the universal joint 19 and the chain stopper arrangement 40. It is hollow to let the chain 8 pass through the mooring unit arm 20. Its length has to be sufficient to rotate the first pair of journals 25*a*, 25*b* and the second pair of journals 26*a*, 26*b* in the bearing with relation to mooring loads and angles.

FIG. 15 shows as previously mentioned, the link element 19'. This element is defined as the universal joint without the journals (25*a*, 25*b*, 26*a*, 26*b*). The element having upwardly extending walls 21 situated on opposite sides of the element. The side or wall 19*b* and the upwardly extending wall is adapted to receive a second pair of ears 17 a on the bracket mounted on the vessel. A first pair of journals 25*a*, 25*b* coupling said second pair of ears of the bracket to the link element 19'. The link element further comprises downwardly extending walls 22 situated on opposite sides of the element. The side or wall 19*c* and the downwardly extending wall 19*c* are adapted to receive a second pair of ears 20 on the mooring arm. A first pair of journals 25*a*, 25*b* coupling said second pair of ears of the mooring arm 20 to the link element. The respective journals is extending through both walls and ear so that they are supported on both sides by both walls.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims.

The invention claimed is:

1. A mooring unit for mooring a vessel, the mooring unit comprising:

a mooring unit arm;

a universal joint with a passage for a mooring chain and a chain stopper arrangement adapted to retain the chain relative to the mooring unit;

wherein the universal joint is arranged between the vessel and the mooring unit arm;

wherein the universal joint is adapted to be pivotally coupled to a vessel mounted bracket and the mooring unit arm enabling the mooring unit to pivot about a first pivot axis and a second pivot axis;

wherein the first and second pivot axes are arranged perpendicular to each other in substantially the same plane;

wherein the universal joint comprises a link element adapted to receive a first pair of ears of the mooring unit arm and a second pair of ears of the bracket, a second pair of journals coupling the first pair of ears to the link element and a first pair of journals coupling the second pair of ears to the link element; and wherein each ear is received in a slit in the link element so that a wall of the link element is formed on both sides of the ear, the respective one of the journal extending through both of the walls and the ear so that the respective journals is supported by both walls.

2. The mooring unit for mooring a vessel according to claim 1, wherein the universal joint having oppositely positioned first pair of journals pivotally coupled to the vessel.

3. The mooring unit for mooring a vessel according to claim 1, wherein the universal joint having oppositely positioned second pair of journals pivotally coupled to the mooring unit arm.

4. The mooring unit for mooring a vessel according to claim 1, wherein the universal joint is equipped with load pins to measure the tension of the chain.

5. The mooring unit for mooring a vessel according to claim 1, wherein the mooring unit further comprising a chain stopper arrangement adapted to support a chain link of the chain.

6. The mooring unit for mooring a vessel according to claim 1, wherein the chain stopper arrangement is located at a bottom portion of the mooring unit arm of the mooring unit.

7. The mooring unit for mooring a vessel according to claim 1, wherein the chain stopper arrangement is located at or near a second end on the mooring unit arm.

8. The mooring unit for mooring a vessel according to claim 5, wherein the chain stopper comprises two chain stopper levers adapted to support the chain on opposite sides of the chain link.

* * * * *